US005205086A

United States Patent [19]

Heim

[11] Patent Number: 5,205,086

[45] Date of Patent: Apr. 27, 1993

[54] INFLATABLE TENT

[76] Inventor: Daniel G. Heim, 27 Fay Road, S.E., Calgary, Alberta, Canada, T2H 1H5

[21] Appl. No.: 865,757

[22] Filed: Apr. 10, 1992

Related U.S. Application Data

[63] Continuation of Ser. No. 632,999, Dec. 24, 1990, abandoned.

[51] Int. Cl.[5] ..... E04B 1/34

[52] U.S. Cl. ..... 52/2.13; 52/2.18; 52/4; 52/DIG. 13; 135/105; 135/114

[58] Field of Search ..... 52/2.11, 2.13, 2.14, 52/2.18, 2.22, 2.23, 2.75, 3, 4, 5, 80, 83, DIG. 12, DIG. 13; 135/105, 106, 102, 107, 96, 114

[56] References Cited

U.S. PATENT DOCUMENTS 3,457,684 1/1967 Wood, Jr. .
3,957,069 5/1976 Denaro ..... 52/DIG. 13
4,000,585 1/1977 Denaro .
4,068,418 1/1978 Masse .
4,335,545 6/1982 Couch .
4,384,435 5/1983 Polise et al. .
4,887,627 12/1989 Audet ..... 52/2.24 X

FOREIGN PATENT DOCUMENTS 2544213 4/1983 France .
2135354 1/1983 United Kingdom ..... 52/2.13
8903468 4/1989 PCT Int'l Appl. ..... 52/2.13

*Primary Examiner*—Richard E. Chilcot, Jr.
*Assistant Examiner*—Kien Nguyen
*Attorney, Agent, or Firm*—Murray E. Thrift; Stanley G. Ade; Adrian D. Battison

[57] ABSTRACT

A tent has a flexible canopy, a floor and a series of inflatable tubes serving as frame hoops. The tubes are fastened removably to the tent using sleeves that open along a longitudinal slit and hook and loop pile fastener closures for closing the sleeves on the tubes.

12 Claims, 2 Drawing Sheets

INFLATABLE TENT

This application is a continuation of application Ser. No. 632,999, filed Dec. 24, 1990.

FIELD OF THE INVENTION

The present invention relates to tents and more particularly to an easily transportable, pole-less tent with an inflatable frame.

BACKGROUND OF THE INVENTION

Various pole-less, inflatable tents have been designed in the past. A number of these have had inflatable walls and floors, which makes for a relatively heavy tent and requires a great deal of inflating air. When a chamber is punctured in the field, it is difficult to repair. Other tents have used an inflatable tube frame concept. The inflatable tubes have relatively thick walls in order to inhibit damage, and are therefore relatively stiff and heavy. The tubes are also permanently fastened to the tent so that any damage to a tube is difficult or impossible to repair.

The present invention is concerned with a novel tent of the inflatable frame type.

SUMMARY OF THE INVENTION

According to the present invention there is provided a tent comprising:

a flexible canopy;

a plurality of inflatable tubes independent of the canopy; and tube holding means for detachably securing the inflatable tubes in an inflated state to the canopy for supporting the canopy in an erected condition.

Preferably, the tube holding means are flexible sleeves secured to the tent canopy. Each sleeve has an end-to-end opening along one side and sleeve fasteners for closing the sleeve. The preferred sleeve fastener is the hook and loop fastener material sold under the trademark "Velcro".

The use of detachable tubes allows a very compact folding of the canopy for transport. The tubes themselves can be made of relatively thin wall material as they can be handled independantly of the canopy, thus minimizing the risk of damage. If damage does occur to a tube, it is relatively easy to fix by repairing the tube when removed from the tent or, where necessary, a replacement. The tubes may conveniently be fabricated from a flexible thermoplastic material.

Where the tubes are external to the canopy, they may be used to support a fly, which may be fastened to the sleeves.

Description of the Drawings

In the accompanying drawings, which illustrate an exemplary embodiment of the present invention.

DETAILED DESCRIPTION

Figure 1:
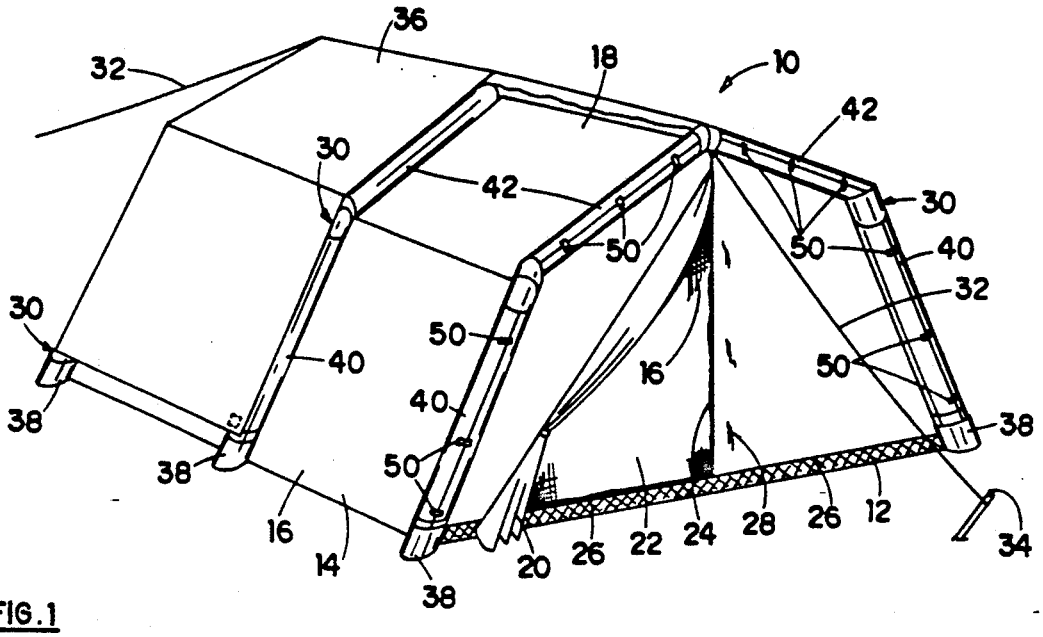
FIG. 1 is an isometric view of a tent according to the present invention.

Referring to the accompanying drawings, especially FIG. 1, there is illustrated a tent 10 having a polypropylene floor 12 and a canopy 14 secured to the edge of the floor. The canopy has two walls 16 and a peaked roof 18. At one end of the tent is a door 20 with an internal screen or fly bar 22 separated up the vertical center by a slide fastener 24 and secured to the top edge of the floor by slide fasteners 26. The weather door itself is a part of the canopy and is closed using door ties 28.

The tent is held in an erect condition by three frame hoops 30 that stretch the canopy into an erect condition as illustrated in FIG. 1 and stretch the floor from side to side. Two main guylines are included, at the front and back of the tent, connected to the canopy adjacent the ridge of the tent. This tensions the canopy from front to back and also ties down the relatively light tent to the ground. The guyline 32 at the front is pegged to the ground using a conventional tent peg 34.

As illustrated in FIG. 1, the tent is equipped with a fly 36 that is supported above the walls and roof of the canopy by the frame hoops 30.

At each corner of the tent, and halfway along each wall 16 is a cup-like boot 38 that is upwardly open. The boot is secured to the tent canopy and floor. Aligned with the boots 38 are sleeves 40 positioned along the front and back edges of the walls 16 and midway along the walls. Roof sleeves 42 are likewise positioned at the front and back edges of the roof 18 and midway along the roof.

The boots 38 and the sleeves 40 and 42 serve to retain three inflatable tubes 44 of flexible vinyl plastic on the tent to provide the three frame hoops 30. The inflatable tube has a profile that follows that of the erect canopy. Its end are seated in the associated boots 38.

Figure 2:
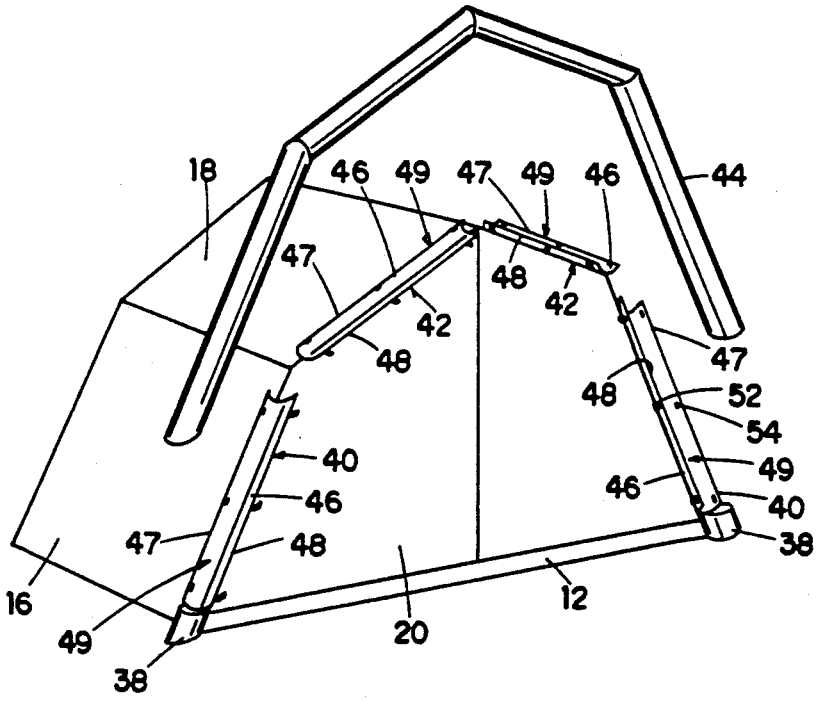
FIG. 2 is an exploded isometric showing a portion of the tent of FIG. 1.
Figure 3:
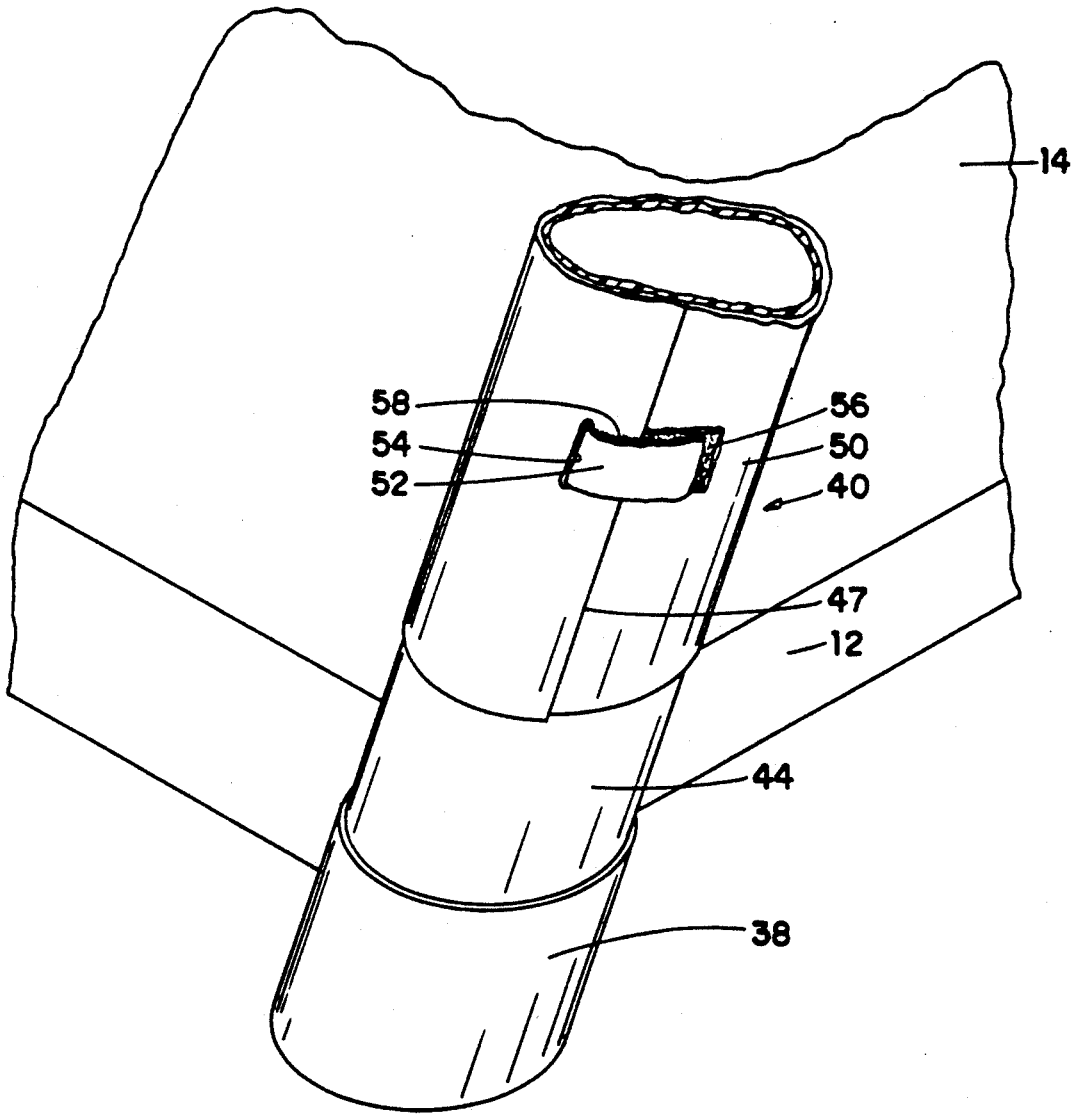
FIG. 3 is a detailed view of a sleeve closing fastener.

The sleeves 40 and 42 are each made of a sheet 46 of textile fabric material secured to the canopy. The sheet has two edges 47 and 48 that define an opening 49 of the sleeve as illustrated most particularly in FIG. 2. The sleeves are held closed with the edges overlapping as illustrated in FIGS. 1 and 3 using sleeve closures 50 spaced along each of the sleeve sheets 46.

Each sleeve closure includes a strip or belt 52 secured to the sheet along one of the edges 48. Along the opposite edge 47 are mating slots 54 through which the belt 52 pass to draw the sleeve closed around a tube 44. The belt 52 is provided with "Velcro" patches 56 and 58 so that when it is fed through the slot 54 it may be folded back on itself to secure the sleeve in a closed condition.

The tubes 44 and their retaining sleeves 40 and 42 are located externally of the canopy 14. They are used for supporting the fly 36 away from the canopy walls and roof so that there is a clear air space between the fly and the canopy itself. The fly is retained in position using mating fasteners 62 on the fly and the sleeves. The fasteners may be interlocking, corrosion resistant nylon fasteners.

While one embodiment of the present invention has been described in the foregoing, it is to be understood that other embodiments are possible within the scope of the invention. The invention is to be considered limited solely by the scope of the appended claims.

What is claimed is:

1. A tent comprising:

a unitary flexible canopy having an extended condition in which the canopy alone encloses a space;

a plurality of inflatable tubes independent of the canopy;

a plurality of tube holding means independent of the canopy and spaced therealong for selectively engaging the inflatable tubes, the tube holding means being readily openable and readily reclosable for selectively removing and replacing the tubes;

securement means securing the tube holding means to the canopy; and fastener means independent of the securement means for selectively fastening the tube holder means in a closed condition, the fastener means being readily engageable and readily disengageable whereby the tubes are selectively and detachably secured to the canopy.

2. A tent according to claim 1 wherein the tube holding means comprise a plurality of flexible sleeves secured to the canopy, each sleeve having longitudinal opening along one side thereof the fastener means comprising sleeve closure means for selectively closing the opening.

3. A tent according to claim 2 wherein each flexible sheet has opposed edges that overlap in a closed condition to provide the sleeve.

4. A tent according to claim 3 wherein the fastener means comprise means spaced along the flexible sheet adjacent the opposed edges thereof.

5. A tent according to any claim 4 wherein the fastener means comprises mating hook and loop pile fastener components.

6. A tent according to claim 2 wherein the sleeves are located externally of the canopy.

7. A tent according to any claim 3 wherein each tube comprises a flexible, thermoplastic material.

8. A tent according to claim 1 wherein each tube is a vinyl plastic material.

9. A tent according to claim 2 wherein each sleeve comprises a flexible sheet secured to the canopy.

10. A tent comprising:

a flexible canopy having an extended condition in which the canopy encloses a space;

a plurality of inflatable tubes independent of the canopy;

tube holding means for engaging the inflatable tubes the tube holding means being readily openable and readily recloseable for selectively removing and replacing the tubes, the tube holding means further comprising boot means secured to the canopy adjacent a bottom edge thereof, the boot means comprising cups engageable over respective ends of the tubes;

securement means securing the tube holding means to the canopy; and fastener means independent of the securement means for selectively fastening the tube holder means in a closed condition, the fastener means being readily engageable and readily disengageable whereby the tubes are selectively and detachably secured to the canopy.

11. A tent comprising:

a flexible canopy having an extended condition in which the canopy encloses a space;

a plurality of inflatable tubes independent of the canopy;

tube holding means comprising a plurality of flexible sleeves for engaging the inflatable tubes, each sleeve having a longitudinal opening along one side thereof whereby the tube holding means are readily openable and readily reclosable for selectively removing and replacing the tubes;

securement means securing the sleeves to the canopy externally of the canopy;

fastener means independent of the securement means for selectively fastening the tube holder means in a closed condition, the fastener means being readily engageable and readily disengageable whereby the tubes are selectively and detachably secured to the canopy; and a fly positioned over the canopy and supported by the tubes.

12. A tent according to claim 11 including fly fastener means for detachably fastening the fly to the sleeves.

* * * * *